US006497733B1

(12) United States Patent
Ware, Jr. et al.

(10) Patent No.: US 6,497,733 B1
(45) Date of Patent: Dec. 24, 2002

(54) DYE FIXATIVES

(75) Inventors: William Ware, Jr., Palo Alto, CA (US); David S. Soane, Piedmont, CA (US); Dan B. Millward, Alameda, CA (US); Matthew R. Linford, Orem, UT (US)

(73) Assignee: Nano-Tex, LLC, Emeryville, CA (US)

( * ) Notice: Subject to any disclaimer, the term of this patent is extended or adjusted under 35 U.S.C. 154(b) by 51 days.

(21) Appl. No.: 09/809,241

(22) Filed: Mar. 15, 2001

Related U.S. Application Data

(60) Provisional application No. 60/194,353, filed on Apr. 3, 2000, and provisional application No. 60/235,013, filed on Sep. 25, 2000.

(51) Int. Cl.[7] ..... C09B 67/00

(52) U.S. Cl. ..... 8/551; 8/552; 8/557; 8/566; 8/576

(58) Field of Search ..... 8/551, 552, 557, 8/566, 576

(56) References Cited

U.S. PATENT DOCUMENTS

| | | | | |
|---|---|---|---|---|
| 3,787,173 | A | * | 1/1974 | Greenshields |
| 4,239,491 | A | * | 12/1980 | Baumgarte et al. |
| 5,512,064 | A | * | 4/1996 | von der Eltz |
| 5,904,738 | A | * | 5/1999 | Purcell |
| 6,042,616 | A | * | 3/2000 | Yanai et al. |

* cited by examiner

*Primary Examiner*—Margaret Einsmann
(74) *Attorney, Agent, or Firm*—Jacqueline S. Larson

(57) ABSTRACT

This invention is directed to treatments for dyed textile goods that will improve their fastness properties. More particularly, the invention is directed to certain fixatives that, when placed on the dyed textile, allow the dye to be permanently or substantially permanently affixed to the fabric. The dye-reactive fixative comprises a water-soluble or water-dispersible polymer or oligomer having reactive groups that react with a dye on a dyed web to affix the dye to the web.

10 Claims, No Drawings

DYE FIXATIVES

This application claims benefit of co-pending Provisional patent application Ser. No. 60/194,353 filed on Apr. 3, 2000, and of co-pending Provisional patent application Ser. No. 60/235,013 filed on Sep. 25, 2000; the disclosures of both of which are incorporated herein by reference.

FIELD OF THE INVENTION

The present invention is directed to the field of fiber and textile dyeing. More specifically, this invention relates to dye fixatives and their use in providing substantially permanent retention of dye color in textiles.

BACKGROUND OF THE INVENTION

Poor washfastness, that is, the leaching and bleeding of dye stuffs from fabrics, along with poor crockfastness, or the removal of dye from fabric when it is abraded, are two significant problems that to one degree or another must be overcome for any dyed good to be used commercially. Some loss of dye will take place from dyed textiles during washing and/or abrasion with all categories of dyes, including sulfur dyes, direct dyes, and vat dyes, e.g., indigo.

A number of coatings or reagents have been developed to improve the fastness properties of dyed textiles. For example, for direct dyes copper aftertreatments and diazotization/coupling have been used to improve fastness. However, the copper (II) ion that is employed in copper aftertreatments is not environmentally friendly, and diazotization requires chemical reactions to be performed on the absorbed dyes in the fibers. For vat dyes, fastness may be improved by soaping (that is, a treatment with a hot aqueous solution of a surfactant), which causes the dye molecules to rearrange and crystallize. Soaping may, however, substantially change the shade of the dyed good and the process can be time-consuming.

SUMMARY OF THE INVENTION

This invention is directed to treatments for dyed textile goods that will improve their fastness properties. More particularly, the invention is directed to certain fixatives that, when placed on the dyed textile, allow the dye to be permanently or substantially permanently affixed to the fabric. The dye-reactive fixative comprises a water-soluble or water-dispersible polymer or oligomer having reactive groups that react with a dye on a dyed web to affix the dye to the web. The dye-reactive fixative, in one embodiment, comprises a polyethylene glycol (PEG) polymer or oligomer that is terminally capped with glycidyl groups or with oxirane rings in other forms, such as epoxycyclohexyl groups. In another embodiment, the dye fixative comprises a mixture of functionalized or unfunctionalized PEG and poly(butadiene), preferably maleinized polybutadiene. In a further embodiment, the dye-reactive fixative comprises a silicone that is terminally capped with epoxide groups or with groups that form anhydrides.

The invention is further directed to the process for treating dyed textiles and other webs with a dye-reactive fixative preparation, wherein the fixative compound or mixture is applied to the fiber, yarn, textile, or other web. In a presently preferred embodiment, the dyed web is placed into the fixative preparation (dipped), then padded and dried in a single continuous process.

This invention is further directed to the dyed fibers, yarns, fabrics, textiles, finished goods, or nonwovens (encompassed herein under the terms "textiles" and "webs") treated with the dye-reactive fixative preparation. Such textiles and webs exhibit a greatly improved colorfastness and resistance to fading, even after multiple launderings.

DETAILED DESCRIPTION OF THE INVENTION

The dye-reactive fixative preparation of the invention comprises, in one embodiment, a glycidyl- or other oxirane-containing polyethylene glycol (PEG) polymer or oligomer. Without being bound by theory, it is believed that the PEG fixative preparation covalently binds to the dye. These dye-reactive PEG preparations provide improved colorfastness and retention of the dye on the textile or web fiber structure.

In one presently preferred embodiment, the dye-reactive PEG fixative comprises a coating or finish composed of a polyethylene glycol (PEG) polymer or oligomer that is terminally capped with glycidyl groups. Other PEG derivatives that contain 1, 3, or more glycidyl groups are also possible, as are PEG oligomers and polymers that contain oxirane rings in other forms, such as epoxycyclohexyl groups. The PEG oligomers and polymers may contain from one ethylene glycol unit up to many thousands. Copolymers of ethylene glycol and propylene glycol that contain one or more oxirane moieties may also be employed. This invention is not limited to oxirane groups as reactive groups on PEG, or copolymers thereof. Reactive groups derived from cyanuric chloride or based on vinyl sulfones or anhydrides may also be used, as well as silicones with epoxide groups or with groups that form anhydrides. Additionally, N-methylol compounds including dimethylol dihydroxyethylene urea (DMDHEU), dimethylol urea (DMU), dimethylol ethylene urea (DMEU), formaldehyde, and the like can be used.

Without being bound by theory, it is believed that glycidyl groups on PEG react with sulfhydryl groups (—SH) (reactions 1a and 1b, below) in sulfur dyes, or with amines (reactions 2a and 2b, below) in other dyes, e.g., direct, vat, sulfur, acid, and disperse dyes. The PEG preparation will crosslink the dye molecules together. Sulfhydryl groups should be present on sulfur-dyed goods because of incomplete coupling to produce disulfides during dye application. The amine group, which is usually attached to an aromatic ring structure but may be aliphatic, is widely found in dye structures. Any crosslinking between dye molecules should increase the substantivity of the dyes in the textile, and a greater degree of crosslinking is to be expected if more than one nucleophilic group is present on the dye. Reactions with hydroxyl, carboxyl, or other nucleophilic groups on dyes may occur. It should also be possible for some oxirane groups to react with nucleophiles that are part of the fiber, such as hydroxyls, amines, carboxyls, sulfhydryls, etc. If such reactions do occur, they would also be expected to increase the substantivity of the dyes.

PEG and the reactive groups taught herein have a number of advantages. PEG is readily available, inexpensive, water-soluble or water-dispersible, and of low toxicity. It also has a low $T_g$, which may help soften the hand of textiles to which it is applied. PEG that is endcapped with glycidyl groups is commercially available in a variety of molecular weights (from, for example, Aldrich) and is reasonably priced. PEG can also be derivatized with cyanuric chloride; the resultant compound can react with dyes and reactive textiles (e.g. cellulosics).

Another approach to improving colorfastness is to add polymeric "nets" to the dyed textile. These nets may react with the textiles and provide physical barriers preventing dye loss during washing. The nets may also chemically react with the dye, thus affixing the dyes to the fabric through chemical bonds. A preferred embodiment of this approach uses a combination of hyperbranched polyethylenimine (PEI) and solubilized chlorotriazines to form textile- and dye-reactive nets.

It should be recognized that seemingly small chemical changes on a dye structure can shift its absorption spectrum and, therefore, the shade on a fabric. For aromatic systems, the electron-donating capability of pendant groups increases in the following order: —OR, —OH, —$NH_2$, —NHR, —$NR_2$, where R is an alkyl group. Therefore, reactivity of an amine that is pendant on an aromatic system with a glycidyl group is expected to red-shift the absorption maximum of the dye, and similar reactivity of a hydroxyl group should blue-shift its absorption maximum.

Some possible reactions of diglycidyl-PEG with sulfhydryls and amines are illustrated below:

1a. Reaction of diglycidyl-PEG with a sulfhydryl group on a dye:

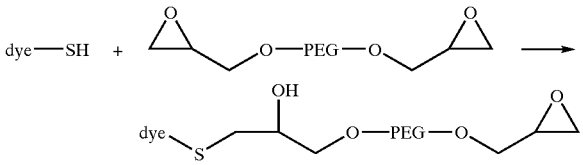

1a. Reaction of singly-reacted diglycidyl-PEG with a second sulfhydryl group on a dye:

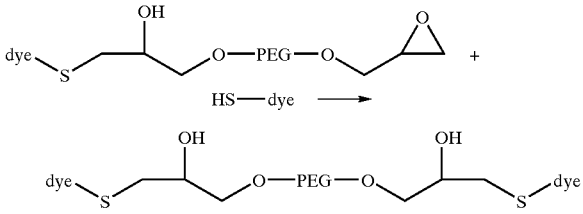

2a. Reaction of diglycidyl-PEG with an amine group on a dye:

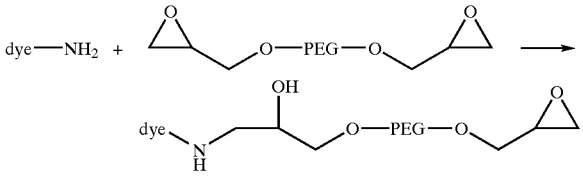

2b. Reaction of singly-reacted diglycidyl-PEG with a second amine group on a dye:

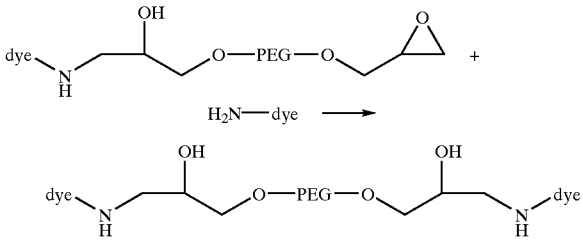

The present invention is further directed to the dyed fibers, yarns, fabrics, finished goods, or other textiles (encompassed herein under the terms "textiles" and "webs") treated with the dye-reactive PEG fixative. These textiles or webs will display improved colorfastness and retention of the dye on the textile or web fiber structure, even after multiple launderings.

The colorfast webs of the present invention are intended to include fabrics and textiles, and may be a sheet-like structure (woven, knitted, tufted, stitch-bonded, or non-woven) comprised of fibers or structural elements. Included with the fibers can be non-fibrous elements, such as particulate fillers, binders, sizes and the like. The textiles or webs include fibers, woven and non-woven fabrics derived from natural or synthetic fibers or blends of such fibers, as well as cellulose-based papers, and the like. They can comprise fibers in the form of continuous or discontinuous monofilaments, multifilaments, staple fibers, and yarns containing such filaments and/or fibers, which fibers can be of any desired composition. The fibers can be of natural, man-made, or synthetic origin. Mixtures of natural fibers, man-made fibers, and synthetic fibers can also be used. Examples of natural fibers include cotton, wool, silk, jute, linen, and the like. Examples of man-made fibers include regenerated cellulose rayon, cellulose acetate, and regenerated proteins. Examples of synthetic fibers include polyesters (including polyethyleneterephthalate), polyamides (including nylon), acrylics, olefins, aramids, azlons, modacrylics, novoloids, nytrils, aramids, spandex, vinyl polymers and copolymers, vinal, vinyon, Kevlare, and the like.

To prepare the webs, the fiber, the yarn, the fabric, or the finished good is dyed in the normal manner and is then exposed (by methods known in the art such as by soaking, spraying, dipping, fluid-flow, padding, and the like) to an aqueous solution or dispersion of the dye-reactive PEG fixative. The treated web is then removed from the solution and dried. The dye-reactive functional groups on the PEG fixative compound react, by covalent bonding, with the dye on the textile or web to permanently or substantially permanently affix the dye to the textile.

Additional additives may be included in the dye-reactive PEG fixative bath. For example, a hydroxyl-containing polymer, such as poly(vinyl alcohol) or starch, may be added to help improve colorfastness. Softeners, such as maleinized polybutadiene for example, or surfactants may also be added. A variety of other chemicals, including but not limited to wetting agents, antioxidants, salts such as sodium sulfate or sodium chloride and acids, bases, or salts that buffer the solution may also be present.

In order to further illustrate the present invention and advantages thereof, the following specific examples are given, it being understood that the same are intended only as illustrative and in nowise limitative.

EXAMPLES

Example 1

An aqueous solution containing 5 wt % diglycidyi-PEG (poly(ethylene glycol) diglycidyl ether, Aldrich, Mn~526) and 0.2% WetAid NRW (a commercially available wetting agent from B. F. Goodrich) were applied to fabric obtained from a pair of black jeans that were purchased from an Old Navy store (it is almost a certainty that the jeans were dyed with a sulfur dye). The wash liquors from a series of accelerated home launderings ("HLs") were collected, centrifuged, and their absorbances were measured by UV-VIS. The absorbances at 450 nm of the wash liquors from a control Oeans fabric not treated with the diglycidyl-PEG solution) and the PEG-treated fabric are given in Table 1 below. The results show what the diglycidyl-PEG fixative prevents dye leakage.

TABLE 1

| | Black Dye Removed by Washing | | | | |
|---|---|---|---|---|---|
| | 1 HL | 2 HL | 3 HL | 4 HL | 5 HL |
| Treated | 0.125 | 0.04 | 0.02 | 0.025 | 0.025 |
| Control | 0.45 | 0.195 | 0.13 | 0.075 | 0.06 |

Example 2

1 Weight % Direct Black 19 (used as received from Dintex Dyechem Ltd., India) and 0.2 wt. % WetAid NRW (B. F. Goodrich) were padded onto cotton twill and then dried for 10 min. at 180° C. The fabric was then dipped in an aqueous solution of 2 wt. % diglycidyl PEG (1000 MW), 0.2 wt. % WetAid NRW (B. F. Goodrich), and 1 wt. % NaCl, padded, and dried for 15 min. at 180° C. Even after multiple home launderings, the color of this fabric remained black and dark while that of the control (only the dye application in the first step) lost its color rapidly.

Example 3

1 Weight % Direct Black 19 (used as received from Dintex Dyechem Ltd., India) and 0.2 wt. % WetAid NRW (B. F. Goodrich) were padded onto cotton twill and then dried for 10 min. at 180° C. The fabric was then dipped in an aqueous solution of 5 wt. % diglycidyl PEG (1000 MW), 0.2 wt. % WetAid NRW (B. F. Goodrich), and 1 wt. % NaCl, padded, and dried for 15 min. at 180° C. Even after multiple home launderings, the color of this fabric remained black and dark while that of the control (only the dye application in the first step) lost its color rapidly.

Example 4

1 Weight % Direct Black 19 (used as received from Dintex Dyechem Ltd., India) and 0.2 wt. % WetAid NRW (B. F. Goodrich) were padded onto cotton twill and then dried for 10 min. at 180° C. The fabric was then dipped in an aqueous solution of 5 wt. % diglycidyl PEG (1000 MW), 0.2 wt. % WetAid NRW (B. F. Goodrich), and 3 wt. % NaCl, padded, and dried for 15 min. at 180° C. Even after multiple home launderings, the color of this fabric remained black and dark while that of the control (only the dye application of the first step) lost its color rapidly.

Example 5

Preparation of Fixative Agent

A 1-L flask was charged with 500 mL of acetone, 38.3 g of PEG (poly(ethylene glycol), Aldrich, 200 MW) and 80 g of sodium carbonate (Fisher). 76.6 Grams of cyanuric chloride (Aldrich) were added portion-wise while stirring. The resulting slurry was stirred under a nitrogen atmosphere for 36 hours. A white solid was filtered off, and the resultant liquid phase was concentrated on a rotary evaporator. This concentration afforded a white solid (unreacted cyanuric chloride) and a liquid phase. The white solid was filtered off. The liquid phase was composed of oligomers of PEG (MW 200) and cyanuric chloride and will hereafter be referred to as "PEG(200)-cyan".

Example 6

A 2 wt % solution of PEG(200)-cyan in water was padded onto a 2"×6" swatch of black denim cloth (supplied by Burlington Industries). The fabric was dried and cured at 350° C. for three minutes. The fabric was washed in a roto-washer for 45 minutes (equivalent to 5 home launderings), and the wash liquor was removed and allowed to settle. The coloration of the wash liquor was compared to that of two control swatches of black denim, one untreated and the other padded in water and cured at 350° C. for three minutes. The treated fabric wash liquor was transparent and colorless, whereas both controls were dark and translucent.

Example 7

A 10% solution of commercially available dimethylol dihydroxyethylene urea (DMDHEU) was prepared with a wetting agent (1 wt %) and a softener (3 wt %). A swatch of overdyed black denim fabric was dipped in the solution and padded to a wet pick-up of 65%. The fabric was then dried at 220° F. and cured at 350° F. for 60 seconds. Treated and untreated fabric swatches were then laundered 30 times in a conventional home laundering machine. Treated swatches showed substantially less color loss than the untreated control. Samples of the laundered treated and untreated fabrics as well as unlaundered untreated fabric were digitally scanned to produce a black and white image. The average grayscale reading from 0 (white) to 255 (black) for each sample was determined using a computer software package. The results are shown in Table 2 below.

TABLE 2

| Sample Description | Grayscale | % Color Loss |
|---|---|---|
| Untreated, unlaundered | 234 | 0% |
| Treated, 30 launderings | 232 | 1% |
| Untreated, 30 launderings | 210 | 10% |

Example 8

A 5% PEI solution was padded onto a swatch of overdyed black denim supplied by Burlington Industries (style 4271). The swatch was then dried at 265° F. and padded with a 5% dichlorotriazinylanilinesulfonate solution at pH 11.5 and dried/cured at 265° F. for three minutes. The swatch was then subjected to 30 HLs (home launderings) along with control swatches of untreated fabric, water-dipped (dry, cure) fabric, and fabric treated with DMDHEU as described in example 7. The resultant swatch was darker than both the untreated and water dipped swatches, and similar to the DMDHEU-treated swatch.

What is claimed is:

1. A dye-reactive fixative comprising a water-soluble or water-dispersible polymer or oligomer selected from the group consisting of polyethylene glycol terminally capped with one or more epoxycyclohexyl groups; a mixture of polyethylene glycol and poly(butadiene); and polyethylene glycol derivatized with cyanuric chloride.

2. A dye-reactive fixative according to claim 1 wherein the polymer or oligomer comprises polyethylene glycol terminally capped with one or more epoxycyclohexyl groups.

3. A dye-reactive fixative according to claim 1 wherein the polymer or oligomer comprises a mixture of polyethylene glycol and poly(butadiene).

4. A dye-reactive fixative according to claim 3 wherein the poly(butadiene) is a copolymer of polybutadiene and maleic anhydride.

5. A dye-reactive fixative according to claim 1 wherein the polymer or oligomer comprises polyethylene glycol derivatized with cyanuric chloride.

6. A colorfast dyed web comprising a dye-reactive fixative compound covalently bonded with the dye on the web to affix the dye to the web, wherein the dye-reactive fixative comprises a water-soluble or water-dispersible polymer or oligomer selected from the group consisting of polyethylene glycol terminally capped with one or more epoxycyclohexyl groups; a mixture of polyethylene glycol and poly (butadiene); and polyethylene glycol derivatized with cyanuric chloride.

7. A colorfast dyed web according to claim 6 wherein the polymer or oligomer comprises polyethylene glycol terminally capped with one or more epoxycyclohexyl groups.

8. A colorfast dyed web according to claim 6 wherein the polymer or oligomer comprises a mixture of polyethylene glycol and poly(butadiene).

9. A colorfast dyed web according to claim 8 wherein the poly(butadiene) is a copolymer of polybutadiene and maleic anhydride.

10. A colorfast dyed web according to claim 1 wherein the polymer or oligomer comprises polyethylene glycol derivatized with cyanuric chloride.

* * * * *